US008002278B2

(12) United States Patent
Tsao

(10) Patent No.: US 8,002,278 B2
(45) Date of Patent: Aug. 23, 2011

(54) PRINTING APPARATUS WITH PLANETARY GEAR UNIT FOR RESOLVING PAPER JAM

(75) Inventor: Yu-Jen Tsao, Taipei (TW)

(73) Assignees: Silitek Electronic (Guangzhou) Co., Ltd., Guangzhou (CN); Lite-On Technology Corp., Taipei (TW)

( * ) Notice: Subject to any disclaimer, the term of this patent is extended or adjusted under 35 U.S.C. 154(b) by 219 days.

(21) Appl. No.: 12/230,191

(22) Filed: Aug. 26, 2008

(65) Prior Publication Data

US 2009/0239701 A1 Sep. 24, 2009

(30) Foreign Application Priority Data

Mar. 21, 2008 (CN) ..... 2008 1 0026967

(51) Int. Cl.
*B65H 5/02* (2006.01)

(52) U.S. Cl. ..... 271/273; 271/274

(58) Field of Classification Search ..... 271/273, 271/274

See application file for complete search history.

(56) References Cited

U.S. PATENT DOCUMENTS

| | | | | |
|---|---|---|---|---|
| 4,581,618 | A * | 4/1986 | Watanabe et al. | 346/134 |
| 5,793,399 | A * | 8/1998 | Kawakami et al. | 347/104 |
| 6,139,011 | A * | 10/2000 | Huang et al. | 271/274 |
| 6,471,202 | B1 * | 10/2002 | Sugimura | 271/10.11 |
| 6,536,762 | B1 * | 3/2003 | Sheng et al. | 271/273 |
| 6,685,183 | B2 * | 2/2004 | Kim | 271/114 |
| 6,929,261 | B2 * | 8/2005 | Nelson et al. | 271/273 |
| 6,962,332 | B2 * | 11/2005 | Su | 271/4.01 |
| 2004/0169330 | A1 * | 9/2004 | Nelson et al. | 271/273 |
| 2008/0191412 | A1 * | 8/2008 | Tu | 271/273 |

* cited by examiner

*Primary Examiner* — David H Bollinger
*Assistant Examiner* — Howard Sanders
(74) *Attorney, Agent, or Firm* — Rosenberg, Klein & Lee

(57) ABSTRACT

A printing apparatus includes a housing including a feeding tray and an ejecting tray, an image forming unit disposed in the housing, a drive motor disposed in the housing, and a driving device disposed in the housing and driven by the drive motor. The driving device is adapted to convey a sheet of paper from the feeding tray onto the ejecting tray, and includes first and second driving units. The first driving unit includes a sun gear rotatable about an axis, a planet carrier rotatable about the axis, and a planetary gear disposed rotatably on the planet carrier and meshing with the sun gear. The second driving unit includes a driven gear meshing with the planetary gear. The planet carrier is pivotable relative to the sun gear to remove the planetary gear from the driven gear.

4 Claims, 8 Drawing Sheets

PRINTING APPARATUS WITH PLANETARY GEAR UNIT FOR RESOLVING PAPER JAM

CROSS-REFERENCE TO RELATED APPLICATION

This application claims priority of Chinese Application No. 200810026967.1, filed on Mar. 21, 2008.

BACKGROUND OF THE INVENTION

1. Field of the Invention

This invention relates to a printing apparatus, and more particularly to a printing apparatus that includes a planetary gear unit for resolving paper jam.

2. Description of the Related Art

U.S. Pat. No. 7,116,926 discloses an image forming device capable of easily solving paper jam that includes a drive motor. When the drive motor rotates in a first direction, the image forming device can convey a paper along a conveying path. When the paper becomes jammed on the conveying path, the drive motor is rotated in a second direction opposite to the first direction for removing the jammed paper from the conveying path. However, if the drive motor is unable to be operated, such as when a sudden electrical power failure occurs, the jammed paper cannot be removed from the conveying path. Furthermore, the rotation of the drive motor in the second direction results in escape of some carbon powders from the toner cartridge The carbon powders escaped from the toner cartridge may drop onto a light-sensing drum, thereby affecting adversely the printing quality.

SUMMARY OF THE INVENTION

An object of this invention is to provide a printing apparatus that can solve paper jam without reversing the rotational direction of a drive motor.

Another object of this invention is to provide a printing apparatus that can solve paper jam even when a sudden electrical power failure occurs.

According to this invention, a printing apparatus comprises:

a housing including a feeding tray and an ejecting tray;

an image forming unit disposed in the housing;

a drive motor disposed in the housing; and a driving device disposed in the housing and driven by the drive motor, the driving device being adapted to convey a sheet of paper from the feeding tray onto the ejecting tray and including a first driving unit including a sun gear rotatable about an axis, a planet carrier rotatable about the axis, and a planetary gear disposed rotatably on the planet carrier and meshing with the sun gear, and a second driving unit including a driven gear meshing with the planetary gear;

wherein the planet carrier is pivotable relative to the sun gear to remove the planetary gear from the driven gear.

Since the planet carrier is pivotable to remove the planetary gear from the driven gear to thereby disconnect the first and second driving units from each other, a jammed paper can be removed from the first and second driving units without reversing the rotational direction of the drive motor and when a sudden electrical power failure occurs.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
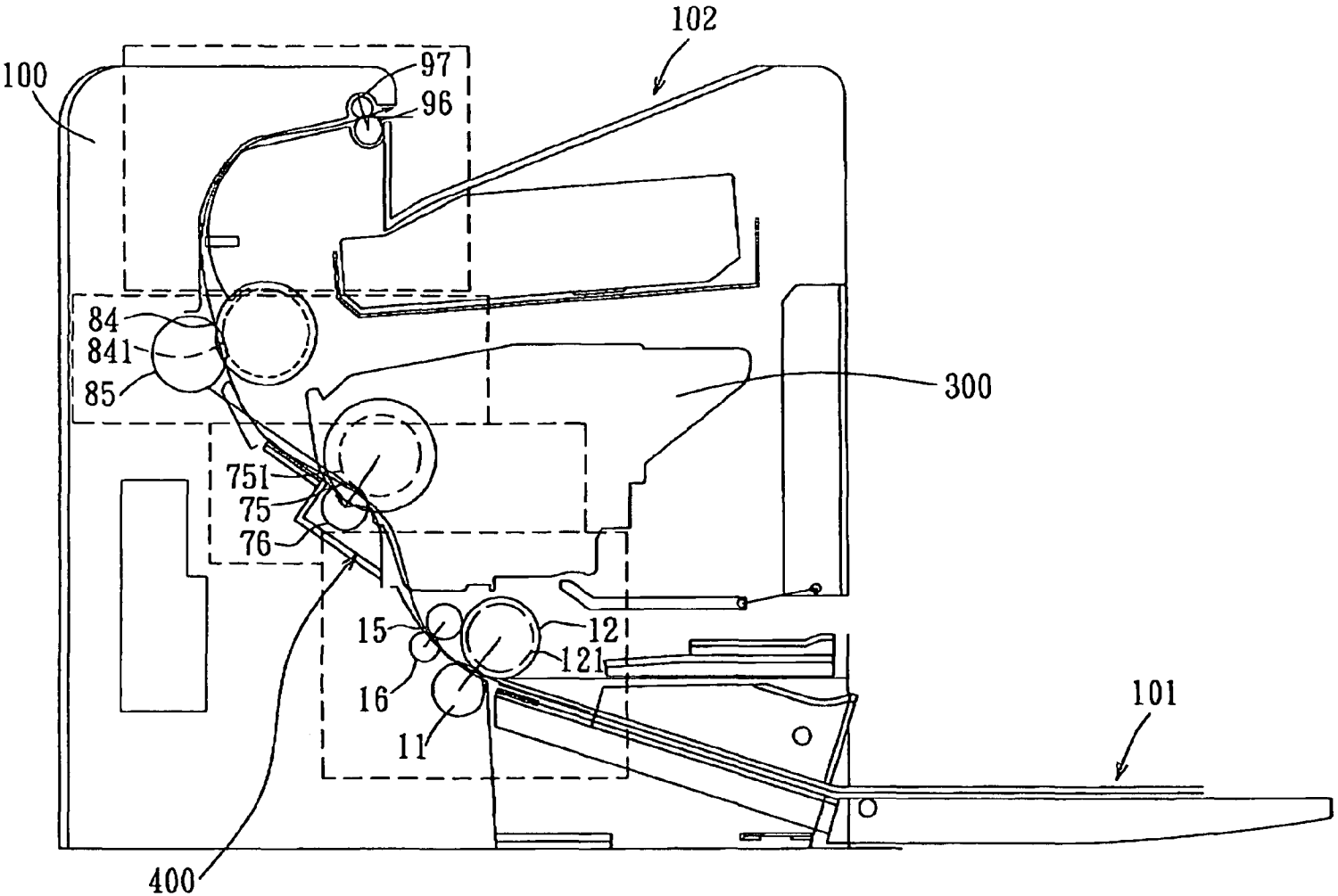
FIG. 1 is a schematic side view of the first preferred embodiment of a printing apparatus according to this invention, illustrating positioning of a toner cartridge relative to a housing.

Before the present invention is described in greater detail in connection with the preferred embodiments, it should be noted that similar elements and structures are designated by like reference numerals throughout the entire disclosure.

Figure 2:
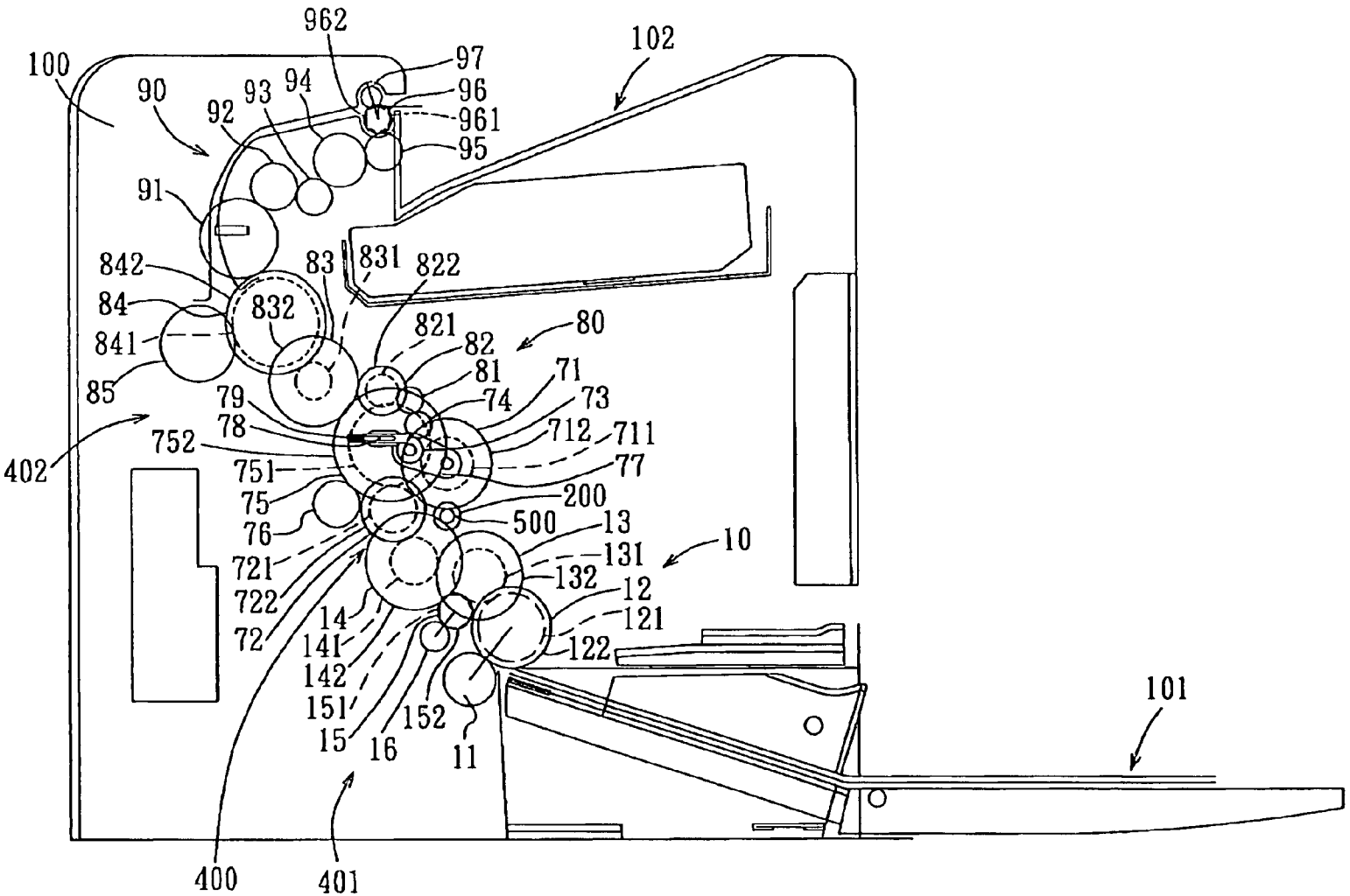
FIG. 2 is a schematic side view of the first preferred embodiment, illustrating first and second driving units of a driving device that are connected to each other.
Figure 5:
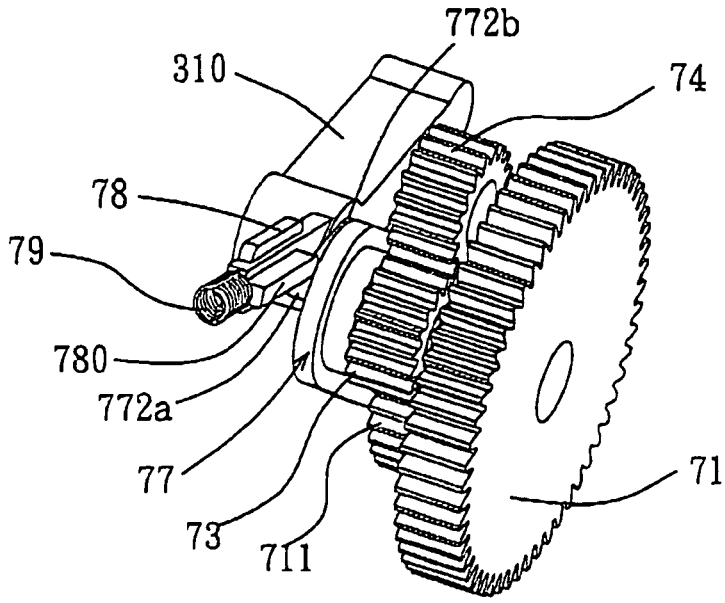
FIG. 5 is a fragmentary assembled perspective view of the first preferred embodiment when a planetary gear meshes with a driven gear.
Figure 6:
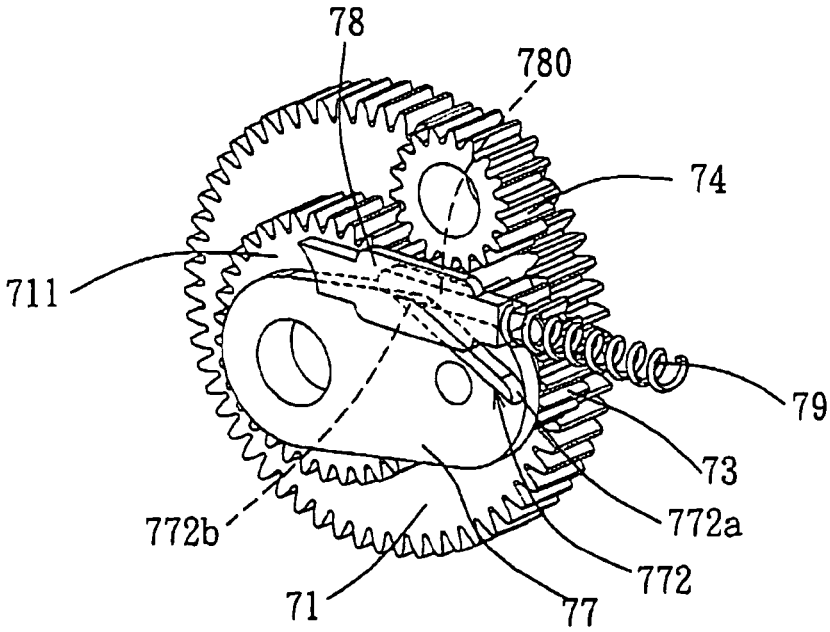
FIG. 6 is a fragmentary assembled perspective view of the first preferred embodiment when the planetary gear is removed from the driven gear by a movable member.
Figure 7:
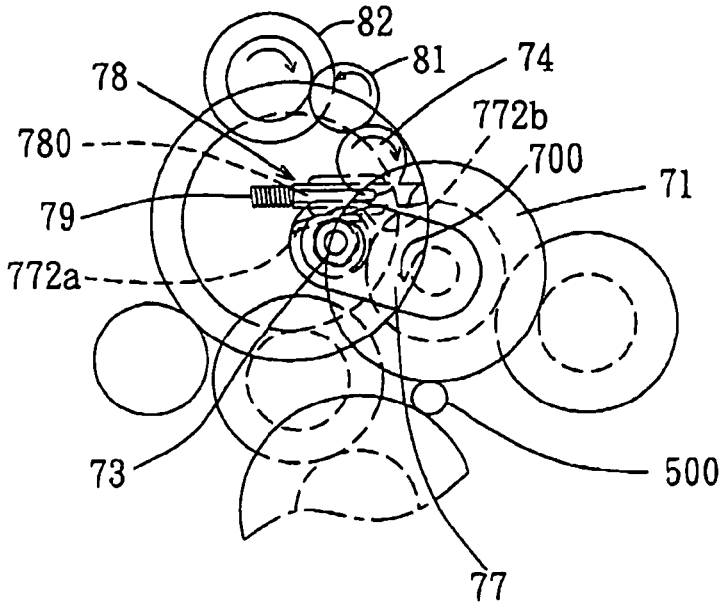
FIG. 7 is a fragmentary schematic side view of the driving device of the first preferred embodiment, illustrating operation of the planetary gear unit when a jammed paper is removed forcibly from the second driving unit.

Referring to FIGS. 1 and 2, the first preferred embodiment of a printing apparatus according to this invention includes a housing 100, an image forming unit, a driving device 400, a drive motor 200, and a driving gear 500 sleeved fixedly on an output shaft (not shown) of the drive motor 200. The housing 100 includes a feeding tray 101 and an ejecting tray 102 disposed above and in front of the feeding tray 101. The image forming unit is disposed in the housing 100, and includes a toner cartridge 300 and a heating device (not shown). The toner cartridge 300 has a positioning portion 310 (see FIG. 5). The driving device 400 is disposed in the housing 100, driven by the drive motor 200 to convey a paper (not shown) from the feeding tray 101 onto the ejecting tray 102, and includes a first driving unit 401, and a second driving unit 402. The second driving unit 402 includes a fixing unit 80, and an ejecting unit 90.

The first driving unit 401 includes a pair of interconnected first and second take-up rollers 11, 12, a pair of interconnected first and second transfer gears 13, 14, and a pair of interconnected first and second conveying rollers 15, 16. Each of the second take-up roller 12, the first and second transfer gears 13, 14, and the first conveying roller 15 is a two-stepped member. Each of the second take-up roller 12 and the first conveying roller 15 has a small-diameter gear portion 121, 151 and a large-diameter roller portion 122, 152. Each of the first and second transfer gears 13, 14 has a small-diameter gear portion 131, 141 and a large-diameter gear portion 132, 142. The small-diameter gear portion 131 of the first transfer gear 13 meshes with the small-diameter gear portions 121, 151 of the second take-up roller 12 and the first conveying roller 15. The large-diameter gear portion 132 of the first transfer gear 13 meshes with the small-diameter gear portion 141 of the second transfer gear 14. The large-diameter gear portion 142 of the second transfer gear 14 meshes with the driving gear 500.

Figure 3:
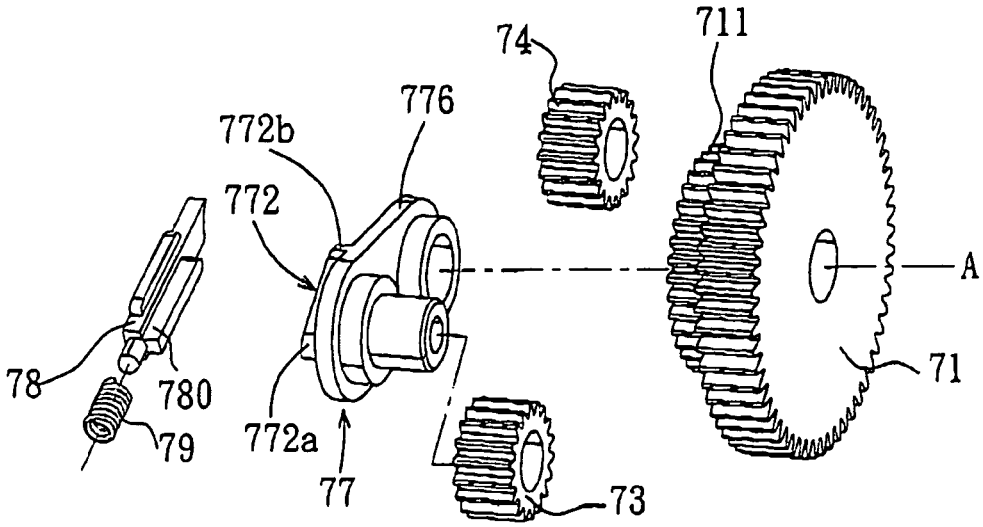
FIG. 3 is a fragmentary exploded perspective view of the first preferred embodiment, illustrating a planetary gear unit.
Figure 4:
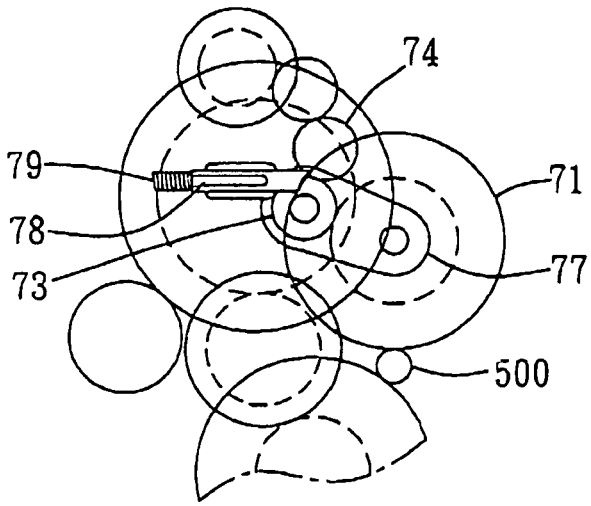
FIG. 4 is a fragmentary schematic side view of the driving device of the first preferred embodiment.

The first driving unit 401 further includes a third transfer gear 71, a fourth transfer gear 72, a planetary gear 73, a pair of interconnected first and second sensing rollers 75, 76, and a planet carrier 77. The third transfer gear 71 is configured as a two-stepped member, and has a small-diameter gear portion 711 serving as a sun gear, and a large-diameter gear portion 712 meshing with the driving gear 500. The fourth transfer gear 72 is also configured as a two-stepped member, and has a small-diameter gear portion 721 and a large-diameter gear portion 722 meshing with the small-diameter gear portion 141 of the second transfer gear 14. The first sensing roller 75 is configured as a two-stepped member, and has a small-diameter gear portion 751 meshing with the small-diameter gear portion 721 of the fourth transfer gear 72, and a large-diameter roller portion 752 in frictional contact with the second sensing roller 76. With further reference to FIGS. 3 and 4, the sun gear 711 and the planet carrier 77 are rotatable about an axis (A). The planetary gear 73 is disposed rotatably on the planet carrier 77, and meshes with the sun gear 711.

With further reference to FIGS. 5, 6, 7, and 8, the second driving unit 402 includes a driven gear 74, a movable member 78, and a resilient member 79. The driven gear 74 meshes with the planetary gear 73. The planetary gear 73 is disposed under the driven gear 74. The movable member 78 has a side surface formed with a horizontal engaging rib 780. The planet carrier 77 has a side surface formed with an inclined engaging rib 772. The inclined engaging rib 772 has a lower end 772*a* (see FIG. 7), an upper end 772*b* (see FIG. 7) disposed above and behind the lower end 772*a*, and an inclined side in slidable contact with the horizontal engaging rib 780 of the movable member 78. The movable member 78 is movable in the housing 100 between a first position shown in FIGS. 5 and 7 and a second position shown in FIGS. 6 and 8.

Figure 8:
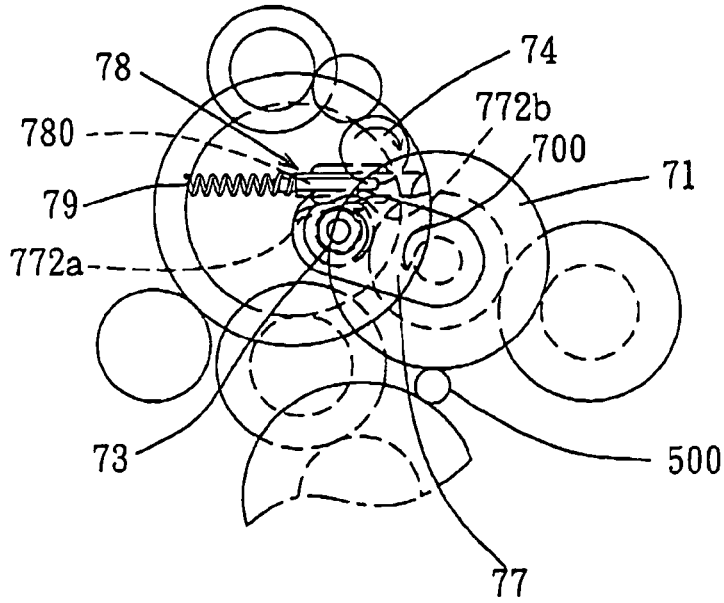
FIG. 8 is a fragmentary schematic side view of the driving device of the first preferred embodiment when the toner cartridge is removed from the housing.

The resilient member 79 is configured as a coiled compression spring, and is disposed between the movable member 78 and the housing 100 for biasing the movable member 78 to the second position. When the toner cartridge 300 is inserted into the housing 100, the movable member 78 is pushed by the toner cartridge 300 to compress the resilient member 79 so that the movable member 78 is moved to the first position, thereby allowing the planetary gear 73 to mesh with the driven gear 74, as shown in FIG. 2. When the toner cartridge 300 is removed from the housing 100, the movable member 78 is biased by the resilient member 70 to move horizontally and rearwardly to the second position to thereby remove the planetary gear 73 from the driven gear 74, as shown in FIG. 8.

The planet carrier 77, the movable member 78, and the resilient member 79 constitute a cartridge-driven unit.

The fixing unit 80 includes a first connecting gear 81, a second connecting gear 82, a third connecting gear 63, and a pair of interconnected first and second fixing rollers 84, 85. Each of the second and third connecting gears 82, 83 is configured as a two-stepped gear, and has a small-diameter gear portion 821, 831 and a large-diameter gear portion 822, 832. The first fixing roller 84 is configured as a two-stepped member, and has a small-diameter roller portion 841 and a large-diameter gear portion 842. The first connecting gear 81 meshes with the driven gear 74 and the small-diameter gear portion 821 of the second connecting gear 82. The large-diameter gear portion 822 of the second connecting gear 82 meshes with the large-diameter gear portion 832 of the third connecting gear 83. The small-diameter gear 831 of the third connecting gear 83 meshes with the large-diameter gear portion 842 of the first fixing roller 84. The small-diameter roller portion 841 of the first fixing roller 84 is in frictional contact with the second fixing roller 85.

The ejecting unit 90 includes interconnected fourth, fifth, sixth, seventh, and eighth connecting gears 91, 92, 93, 94, 95 as well as a pair of interconnected first and second ejecting rollers 96, 97. The first ejecting roller 96 is configured as a two-stepped member, and has a small-diameter gear portion 961 meshing with the eighth connecting gear 95, and a large-diameter roller portion 962 in frictional contact with the second ejecting roller 97. A paper-conveying path is defined by a first nip defined by the first and second take-up rollers 11, 12, a second nip defined by the first and second conveying rollers 15, 16, a third nip defined by the first and second sensing rollers 75, 76, a fourth nip defined by the first and second fixing rollers 84, 85, and a fifth nip defined by the first and second ejecting rollers 96, 97.

When the printing apparatus is in a state of use, since the toner cartridge 300 is disposed in the housing 100, the movable member 78 is pushed by the toner cartridge 300 to compress the resilient member 79 so that the movable member 78 is moved to the first position, thereby allowing the planetary gear 73 to mesh with the driven gear 74, as described above. As such, when the drive motor 200 is operated, the driving gear 500 rotates the second and third transfer gears 14, 71.

Figure 11:
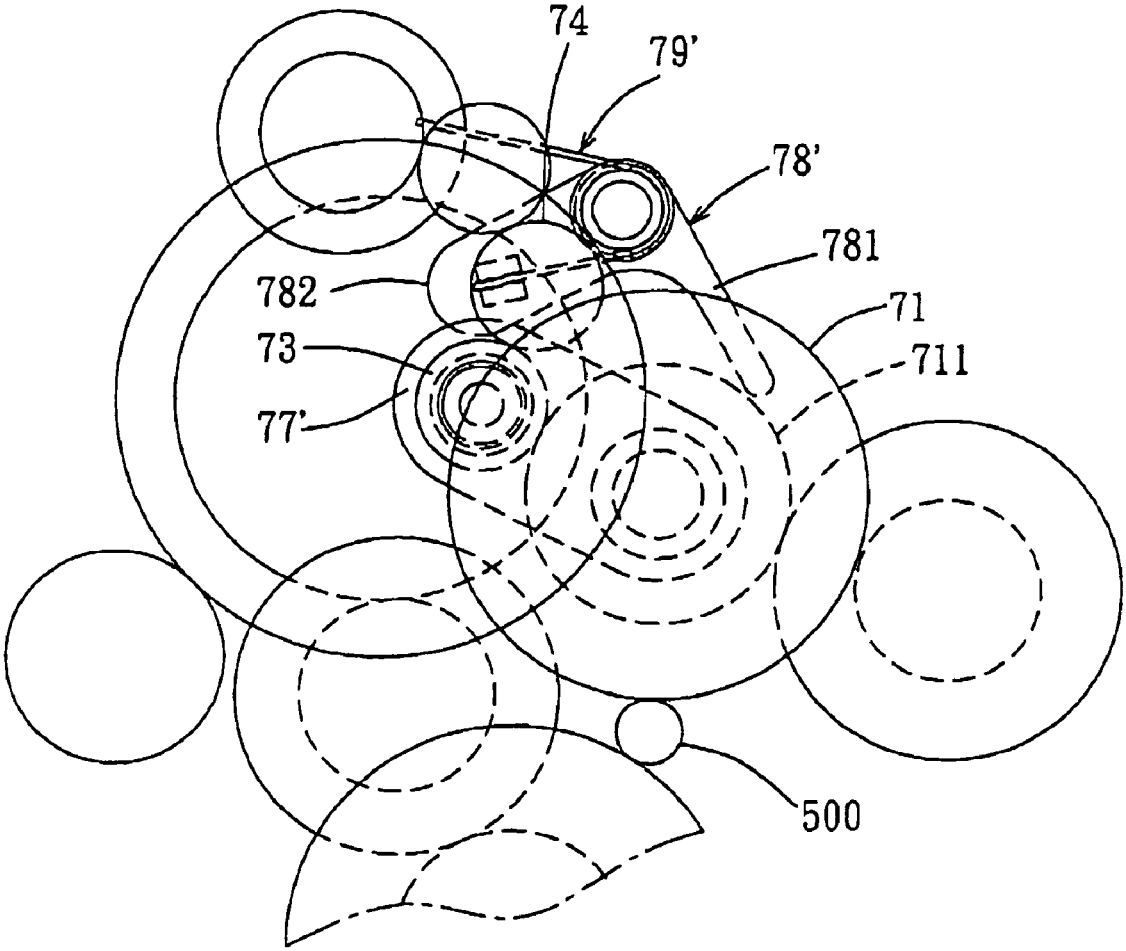
FIG. 11 is a fragmentary schematic side view of the second preferred embodiment, illustrating first and second driving units connected to each other.

When the third transfer gear 71 is driven by the driving gear 500 to rotate clockwise, the planet carrier 77 also rotates clockwise to move the planetary gear 73 to mesh with the driven gear 74 to thereby activate the fixing unit 80 and the ejecting unit 90 such that the driven gear 74 is driven by the planetary gear 73 to rotate counterclockwise, as shown in FIG. 11.

Figure 12:
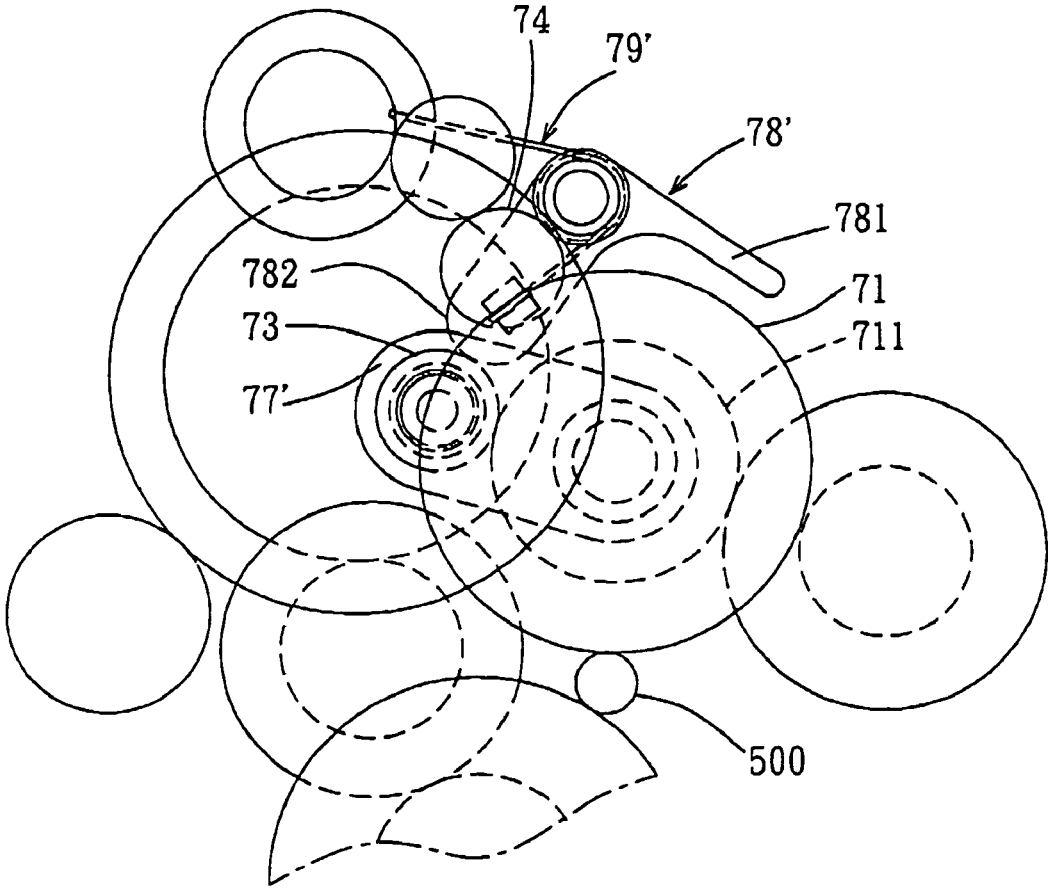
FIG. 12 is a view similar to FIG. 11 but illustrating the first and second driving units disconnected from each other.

In a situation where the paper is jammed in the fixing unit 80 or the ejecting unit 90, for example due to electrical power failure such that a leading edge of the jammed paper is exposed, to remove the jammed paper, the leading edge of the jammed paper is pulled to activate the fixing unit 80 and the ejecting unit 90 to thereby rotate the driven gear 74 counterclockwise. Since the planetary gear 73 meshes with the sun gear 711, and since the sun gear 711 is fixed, counterclockwise rotation of the driven gear 74 results in removal of the planetary gear 73 from the driven gear 74 and, thus, disconnection of the first and second driving units 401, 402 from each other, as shown in FIG. 12. Hence, the jammed paper can be pulled out with ease.

In a situation where the paper is jammed in the first driving unit 401 such that a trailing edge of the jammed paper is exposed in the feeding tray.101, to remove the jammed paper, the toner cartridge 300 is removed from the housing 100 so that the movable member 78 is biased by the resilient member 70 to move to the second position to thereby remove the planetary gear 73 from the driven gear 74, as described above. Hence, the trailing edge of the jammed paper can be pulled out in a rearward direction with ease.

Figure 9:
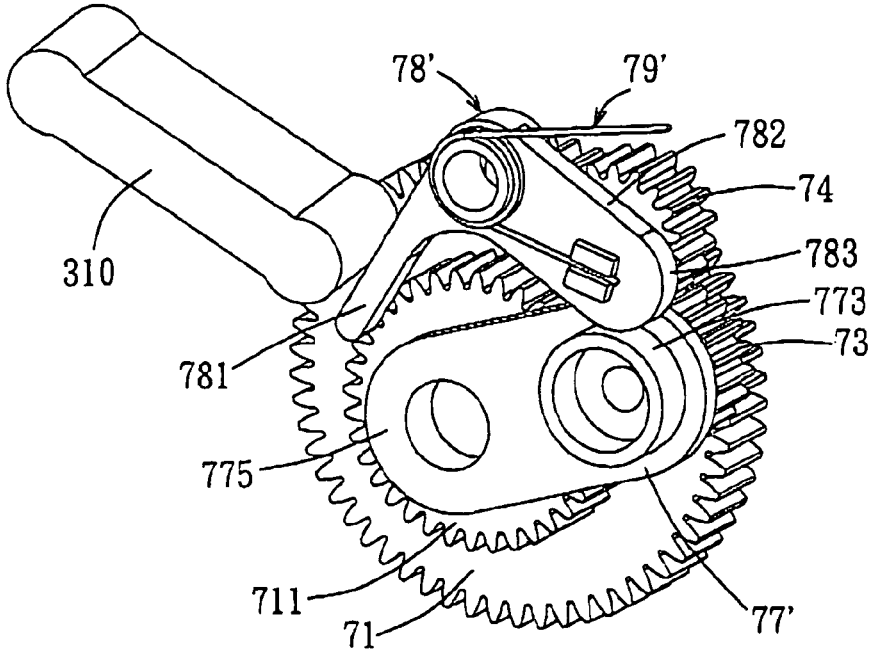
FIG. 9 is a fragmentary perspective view of the second preferred embodiment of a printing apparatus according to this invention when a toner cartridge is disposed in a housing.
Figure 10:
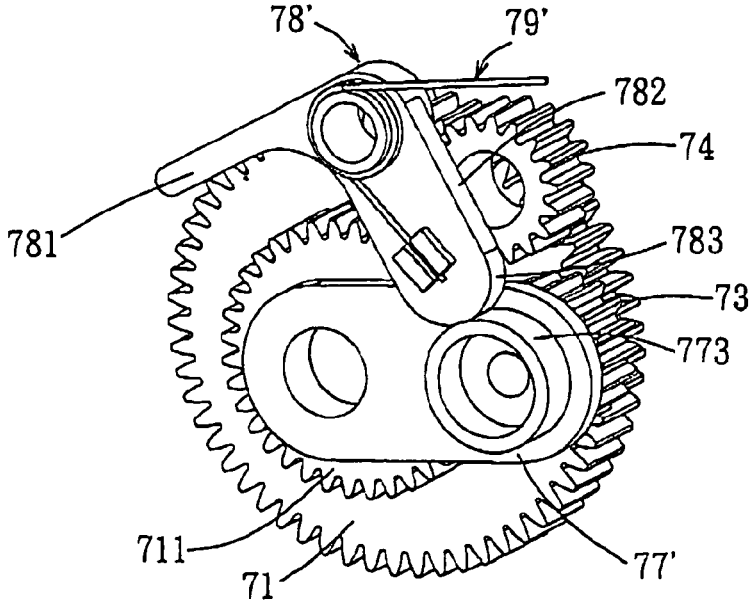
FIG. 10 is a fragmentary perspective view of the second preferred embodiment when the toner cartridge is removed from the housing.

FIGS. 9 and 10 show the second preferred embodiment of a printing apparatus according to this invention, which has a modified cartridge-driven unit. The modified cartridge-driven unit includes a planet carrier 77', a pivotable member 78', and a resilient member 79'.

The pivotable member 78' is disposed pivotally in the housing, and is pivotable between a first position shown in FIG. 9 and a second position shown in FIG. 10. In this embodiment, the pivotable member 78' is configured as a crank, and has first and second crank arms 781, 782.

The resilient member 79' is configured as a torsion spring, and is disposed between the pivotable member 78' and the housing for biasing the pivotable member 78' to the second position.

The planet carrier 77' has a side surface formed with an projecting ring 773.

When the positioning portion 310 of the toner cartridge is inserted into the housing, the pivotable member 78' is pushed by the positioning portion 310 to pivot to the first position against the biasing action of the resilient member 79'. Hence, the second crank arm 782 of the pivot member 78' pushes and rotates the planet carrier 77' to thereby allow the planetary gear 73 to mesh with the driven gear 74.

When the toner cartridge is removed from the housing, the pivotable member 78' is biased by the resilient member 79' to the second position to thereby remove the planetary gear 73 from the driven gear 74.

With this invention thus explained, it is apparent that numerous modifications and variations can be made without departing from the scope and spirit of this invention. It is therefore intended that this invention be limited only as indicated by the appended claims.

I claim:

1. A printing apparatus comprising:

a housing including a feeding tray and an ejecting tray;

an image forming unit disposed in said housing;

a drive motor disposed in said housing; and a driving device disposed in said housing and driven by said drive motor, said driving device being adapted to convey a sheet of paper from said feeding tray onto said ejecting tray and including:

a. a first driving unit including a sun gear rotatable about an axis, a planet carrier rotatable about the axis, and a planetary gear disposed rotatably on said planet carrier and meshing with said sun gear, and b. a second driving unit including a driven gear meshing with said planetary gear;

a movable member movable in said housing between first and second positions, wherein when said movable member is moved from said first position to said second position, said planetary gear is pushed by said movable member to remove from said driven gear; and a coiled compression spring disposed between said movable member and said housing for biasing said movable member to said second position;

wherein said planet carrier is pivotable relative to said sun gear to remove said planetary gear from said driven gear; and said image forming unit includes a toner cartridge disposed removably in said housing and positioned such that, when said toner cartridge is inserted into said housing, said movable member is pushed by said toner cartridge to compress said coiled compression spring so that said movable member is moved to said first position, thereby allowing said planetary gear to mesh with said driven gear, and when said toner cartridge is removed from said housing, said movable member is biased by said coiled compression spring to said second position to thereby remove said planetary gear from said driven gear.

2. The printing apparatus as claimed in claim 1, wherein said planetary gear is disposed under said driven gear, said movable member having a side surface formed with a horizontal engaging rib, said planet carrier having a side surface formed with an inclined engaging rib, said engaging rib having an inclined side in slidable contact with said horizontal engaging rib of said movable member such that, when said movable member is moved horizontally from said first position to said second position, said planetary gear is moved downwardly away from said driven gear.

3. A printing apparatus comprising:

a housing including a feeding tray and an ejecting tray;

an image forming unit disposed in said housing;

a drive motor disposed in said housing; and a driving device disposed in said housing and driven by said drive motor, said driving device being adapted to convey a sheet of paper from said feeding tray onto said ejecting tray and including:

a. a first driving unit including a sun gear rotatable about an axis, a planet carrier rotatable about the axis, and a planetary gear disposed rotatably on said planet carrier and meshing with said sun gear, and b. a second driving unit including a driven gear meshing with said planetary gear;

a pivotable member disposed pivotally in said housing and pivotable between first and second positions, wherein, when said pivotable member is pivoted from said first position to said second position, said planetary gear is pushed to remove from said driven gear; and a torsion spring disposed between said pivotable member and said housing for biasing said pivotable member to said second position;

wherein said planet carrier is pivotable relative to said sun gear to remove said planetary gear from said driven gear; and said image forming unit includes a toner cartridge disposed removably in said housing and positioned such that, when said toner cartridge is inserted into said housing, said pivotable member is pivoted by said toner cartridge to said first position, and when said toner cartridge is removed from said housing, said pivotable member is biased by said torsion spring to said second position to thereby remove said planetary gear from said driven gear.

4. The printing apparatus as claimed in claim 3, wherein said planetary gear is disposed under said driven gear, said planet carrier having a side surface formed with an projecting ring, said projecting ring having an annular outer surface, said pivotable member being configured as a crank and having a first crank arm and a second crank arm that are positioned such that, when said toner cartridge is inserted into said housing, said pivotable member is pushed by said toner cartridge to pivot to said first position against biasing action of said torsion spring so that said second crank arm of said pivotable member pushes and rotates said planet carrier and to thereby allow said planetary gear to mesh with said driven gear.

* * * * *